US007492256B2

(12) United States Patent
Eren et al.

(10) Patent No.: US 7,492,256 B2
(45) Date of Patent: Feb. 17, 2009

(54) TILT DETECTING APPARATUS AND METHOD

(75) Inventors: Selcuk Suat Eren, Chapel Hill, NC (US); Brian Jules Jaeger, Chapel Hill, NC (US); Douglas Alan Law, Chapel Hill, NC (US); Paul Allen Roberts, Raleigh, NC (US); Shawn Konrad Sremaniak, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 483 days.

(21) Appl. No.: 11/320,930

(22) Filed: Dec. 29, 2005

(65) Prior Publication Data

US 2007/0152841 A1 Jul. 5, 2007

(51) Int. Cl.
*G08B 13/14* (2006.01)

(52) U.S. Cl. ..... 340/572.1; 340/572.8; 340/686.1; 340/686.2; 340/689

(58) Field of Classification Search ..... 340/572.1, 340/572.8, 686.1, 686.2, 689
See application file for complete search history.

(56) References Cited

U.S. PATENT DOCUMENTS

| | | | | |
|---|---|---|---|---|
| RE32,570 | E | 1/1988 | Conn | |
| 6,121,544 | A | 9/2000 | Petsinger | 174/35 R |
| 7,088,258 | B2 * | 8/2006 | Morrison | 340/689 |
| 7,336,184 | B2 * | 2/2008 | Smith et al. | 340/572.4 |
| 2002/0036569 | A1 * | 3/2002 | Martin | 340/573.1 |
| 2004/0069850 | A1 | 4/2004 | De Wilde | 235/385 |
| 2004/0233054 | A1 | 11/2004 | Neff et al. | 340/539.1 |
| 2004/0246104 | A1 | 12/2004 | Baechtiger et al. | 340/10.41 |
| 2004/0246130 | A1 | 12/2004 | Lambright et al. | 340/539.26 |
| 2005/0073418 | A1 * | 4/2005 | Kelliher et al. | 340/572.1 |
| 2005/0242950 | A1 * | 11/2005 | Lindsay et al. | 340/539.26 |
| 2007/0152841 | A1 * | 7/2007 | Eren et al. | 340/689 |

OTHER PUBLICATIONS

U.S. Appl. No. 11/024,915, filed Dec. 28, 2004, Chi et al.

* cited by examiner

*Primary Examiner*—George A Bugg
*Assistant Examiner*—Son M Tang
(74) *Attorney, Agent, or Firm*—Duke W. Yee; Mark E. McBurney; Lisa L. B. Yociss

(57) ABSTRACT

An apparatus and method are disclosed for detecting whether a device has been tilted beyond a predefined threshold. A casing is included for temporarily enclosing a radio frequency identification (RFID) tag. The RFID tag is unable to receive an RFID interrogation signal when the RFID tag is enclosed in the casing. The tilting of the device is monitored. In response to the amount of tilt exceeding the predefined threshold, the RFID tag is exposed to radio frequency (RF) signals. The RFID tag receives the RFID interrogation signal when the RFID tag is exposed. The RFID tag transmits a reply RFID signal in response to a receipt by the RFID tag of the RFID interrogation signal. The RFID tag transmits the RFID reply signal only when the RFID tag is exposed which indicates that tilting of the device beyond the predefined threshold has occurred.

20 Claims, 9 Drawing Sheets

TILT DETECTING APPARATUS AND METHOD

BACKGROUND OF THE INVENTION

1. Field of the Invention

The present invention relates generally to data processing systems and, more specifically, to a tilt detecting apparatus and method. Still more particularly, the present invention is an apparatus and method for determining whether a product has been tilted beyond a predetermined threshold.

2. Description of the Related Art

Products, such as sensitive hardware, need to be shipped within a definitive position range to prevent damage. Tilting or jolting the product beyond a defined threshold needs to be recorded so that carriers and recipients can quickly identify whether a product has been damaged or shifted in transport.

A current solution to this problem is to affix a device to the outside of the package that provides a visual indication that the package has exceeded the defined tilt range. One problem with this solution is that the device must be affixed to the outside of the packaging in which the product is shipped. The device cannot be affixed to the product itself within the package because the device would no longer be visible. A product could be tilted within its packaging beyond the predefined threshold while the packaging itself is not tilted beyond the threshold.

Another problem with this solution is that the individual who is responsible for receiving and and/or transporting the package needs to search for, discover, view, and read the visual indication of this device to determine whether the package has been tilted in an amount that exceeds the threshold. Detecting whether the package has been tilted beyond the threshold is made especially difficult if the package is one of multiple packages shipped together as a single unit on a pallet. The package may be positioned on the pallet such that the side of the package to which the device is affixed rests against the side of another package and is not visible while the package is on the pallet.

BRIEF SUMMARY OF THE INVENTION

An apparatus and method are disclosed for detecting whether a device has been tilted beyond a predefined threshold. A casing is included for temporarily enclosing a radio frequency identification (RFID) tag. The RFID tag is unable to receive an RFID interrogation signal when the RFID tag is enclosed in the casing. The tilting of the device is monitored. In response to the amount of tilt exceeding the predefined threshold, the RFID tag is exposed to radio frequency (RF) signals. The RFID tag receives the RFID interrogation signal when the RFID tag is exposed. The RFID tag transmits a reply RFID signal in response to a receipt by the RFID tag of the RFID interrogation signal. In this manner, the RFID tag will transmit an RFID reply signal only when the RFID tag is exposed which indicates that tilting of the device beyond the predefined threshold has occurred.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
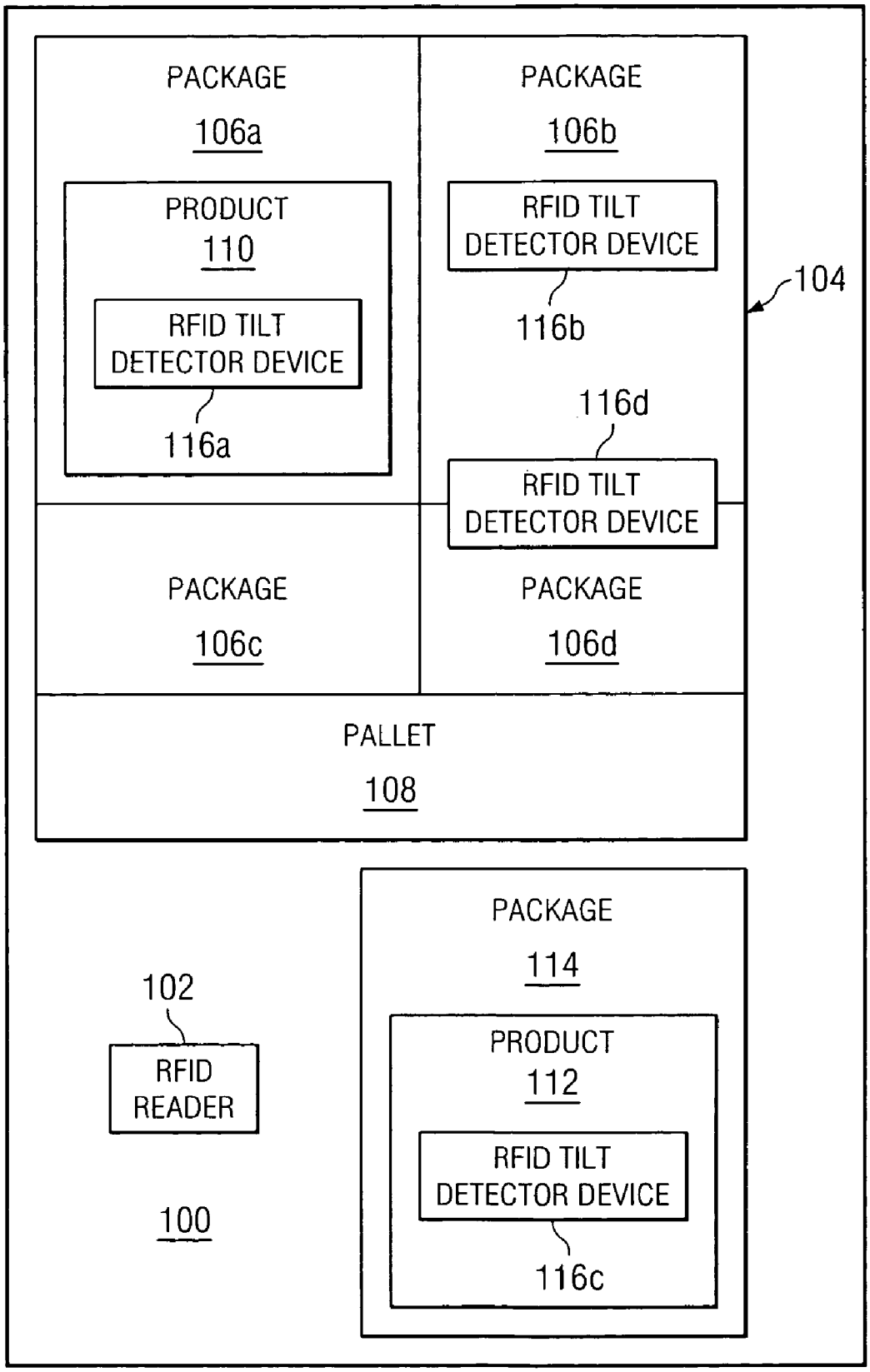
FIG. 1 is a block diagram of an environment that includes an RFID reader and a palletized load in accordance with the illustrative embodiment of the present invention.

The illustrative embodiment of the present invention is an apparatus and method for monitoring whether a product, package, palletized load, or other device has been tilted beyond one or more particular predefined thresholds. The illustrative embodiment uses a radio frequency identification (RFID) tag that is unreadable until the package has been tilted in an amount that exceeds the defined threshold. Once the package has been tilted such that the amount of tilt exceeds the threshold, the RFID tag will automatically become exposed which enables an RFID reader to read the RFID tag.

This illustrative embodiment allows the individual who is responsible for receiving or transporting the product to determine whether the product was tilted in an amount that exceeded the predefined threshold without having to visually view the tilt detecting device. A person will be able to determine whether the package was tilted beyond the defined range without requiring manual visual inspection of the tilt detecting device.

Another advantage of the illustrative embodiment is that it can be placed within the shipping package to prevent tampering with the tilt detecting device. In this manner, the tilt detecting device can be attached to the product itself, rather than the packaging in which the product is shipped, to provide a more accurate measurement of the movement of the product.

The illustrative embodiment uses a passive RFID tag enclosed in an aluminum UHF shielded shell that will prevent the RFID tag from reflecting RFID signals back to an RFID reader. Once the tilt detecting device has been activated, the RFID tag will slide out of the aluminum shell where it can provide an RFID reply signal that is the reflection of the RFID signal that was transmitted by an RFID reader. The RFID reply signal can then be received by RFID readers, thus, indicating that the product was tilted in an amount that exceeded the defined position range.

The reply signal that an activated RFID tag transmits back to the RFID reader includes that RFID tag's unique identifier. In this manner, the RFID reader can identify which tilt detecting device has been activated.

The illustrative embodiment of the present invention includes a passive RFID tag as part of a tilt detecting device. A passive RFID tag does not have an external power source. A passive RFID tag receives enough power to generate a signal through an RF excitation interrogation signal received from an RFID reader.

RFID readers broadcast interrogation signals that are received within a particular geographical range. An RFID tag that is capable of receiving and processing an interrogation signal then responds to the signal by transmitting the RFID tag's unique RFID identifier back to the RFID reader. The unique RFID identifier is assigned to the particular RFID tag to uniquely identify that RFID tag and to distinguish it from other RFID tags.

An RFID tag includes a microchip. The microchip is the logic within the RFID tag that processes and responds to interrogation signals. The microchip is responsible for transmitting the RFID tag's RFID identifier in response to interrogation signals that the RFID tag receives.

According to another embodiment of the present invention, the RFID reader includes a Global Positioning System (GPS) device that is capable of providing an indication of the RFID reader's location when the GPS device is read. According to this embodiment, when the RFID reader detects the presence of an RFID tag by receiving the RFID reply signal, the RFID reader can also read the GPS device to determine the current navigational location of the RFID reader. The time can also be read from a clock that is provided within the RFID reader. In this manner, the time and location of the tilt event can be recorded for later use.

When the passive RFID tag is exposed, which indicates that the product to which the RFID tag is affixed has been tilted beyond the predefined threshold, the RFID reader will detect the presence of the RFID tag and will record the location and time when this event occurred.

This embodiment of the present invention logs threshold-exceeding events and immediately provides notification so appropriate actions can be taken well before the shipment arrives at its destination.

FIG. 1 is a block diagram of an environment 100 that includes an RFID reader 102 and a palletized load 104 in accordance with the illustrative embodiment of the present invention. Multiple packages 106*a-d* are often shipped on a pallet 108. Packages 106*a-d* are typically stacked on pallet 108 to form a single palletized unit 104.

Each package includes one or more products, such as product 110. Alternatively, a product 112 may be shipped in an individual package, such as package 114, that is not palletized. Product 110 is stored completely within package 106*a* such the product 110 is not visible. Product 112 is stored completely within package 114 such that product 112 is not visible.

The preferred embodiment of the present invention is a tilt detecting device, such as tilt detecting devices 116*a-c*, that is can be affixed to the product itself, affixed to a package in which a product is shipped, affixed to a palletized load, or affixed to any other device for which tilting needs to be monitored.

For example, tilt detecting device 116*a* is affixed to product 110. Tilt detecting device 116*a* cannot be viewed when product 110 is stored within package 106*a*. Tilt detecting device 116*b* is affixed to package 106*b* that includes a product that is stored within package 106*b*. Tilt detecting device 116*c* is affixed to product 112 that is included within package 114. Tilt detecting device 116*c* cannot be view as long as product 112 is stored within package 114. Tilt detecting device 116*d* is affixed to palletized load 104.

Tilting of palletized load 104 is monitored by tilt detecting devices 116*a*, 116*b*, and 116*d* if all three tilt detecting devices are present. Tilting of package 106*b* is monitored by tilt detecting device 116*b*. Tilting of product 110 is monitored by tilt detecting device 116*a*. Tilting of product 112 is monitored by tilt detecting device 116*c*.

As depicted by FIG. 1, tilt detecting devices 116*a* and 116*b* are not visible to an operator. Although these tilt detecting devices 116*a* and 116*b* are not visible, they can be read by reader 102 when either or both tilt detecting device is activated.

Reader 102 continuously transmits an interrogation radio frequency (RF) RFID signal. This interrogation RFID signal is received within environment 100. Any tilt detecting devices within the transmission range of reader 102 that have been activated will receive the RFID signal that was transmitted by reader 102 and will then respond to the signal by transmitting a reply radio frequency (RF) RFID signal back to reader 102. Tilt detecting devices within environment 100 that are not activated will not respond to reader's 102 interrogation signal. If no tilt detecting device within the transmission range of reader 102 has been activated, reader 102 will not receive a reply RFID to the interrogation RFID signal transmitted by reader 102.

All activated tilt detecting devices will transmit their unique RFID identifier back to reader 102 in response to reader's 102 interrogation signal. Inactivated tilt detecting devices will not transmit a response to the interrogation signal. In this manner, reader 102 can identify any tilt detecting devices that have been activated.

Environment 100 can be a limited geographical space, such as a loading dock, the interior of a shipping truck, a shipping container, or any other defined area. Environment 100 can also be an undefined area that is merely the extent of the transmission range of reader 102.

Figure 2:
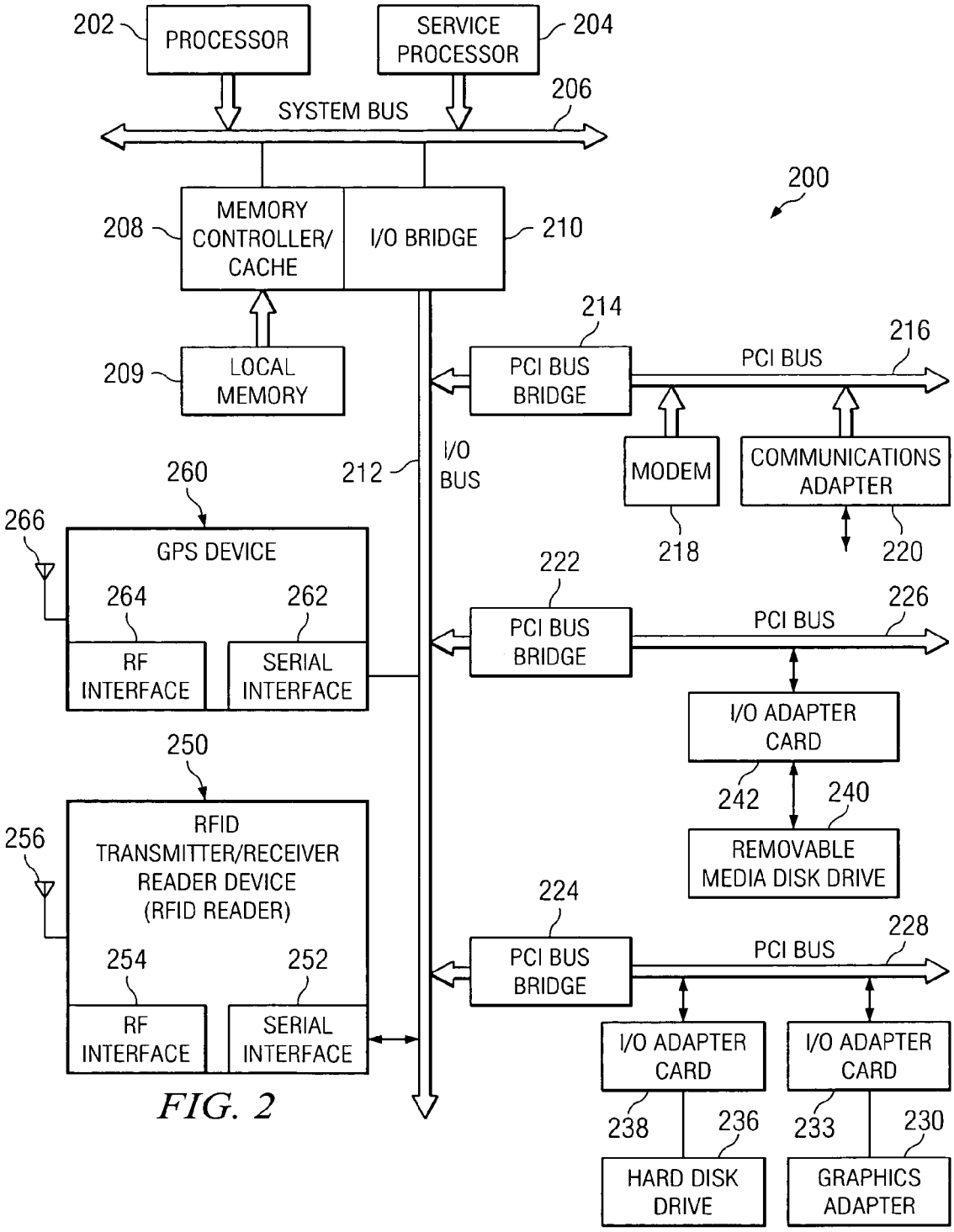
FIG. 2 is a block diagram of a computer system that includes the illustrative embodiment of the present invention.

FIG. 2 is a block diagram of a computer system that includes the illustrative embodiment of the present invention. Computer system 200 can be used as the RFID reader, or may include an RFID reader, such as reader 250.

Computer system 200 may be a symmetric multiprocessor (SMP) system including a plurality of processors 202 and 204 connected to system bus 206. Alternatively, a single processor system may be employed. In the depicted example, processor 204 is a service processor. Also connected to system bus 206 is memory controller/cache 208, which provides an interface to local memory 209. I/O bus bridge 210 is connected to system bus 206 and provides an interface to I/O bus 212. Memory controller/cache 208 and I/O bus bridge 210 may be integrated as depicted.

Peripheral component interconnect (PCI) bus bridge 214 connected to I/O bus 212 provides an interface to PCI local bus 216. A number of modems may be connected to PCI bus 216. Typical PCI bus implementations will support four PCI expansion slots or add-in connectors. Communications links to other computers may be provided through modem 218 and communications adapter 220 connected to PCI local bus 216 through add-in boards.

Additional PCI bus bridges 222 and 224 provide interfaces for additional PCI buses 226 and 228, from which additional modems or network adapters may be supported. In this manner, data processing system 200 allows connections to multiple network computers.

A memory-mapped graphics adapter 230 is connected to PCI bus 228 through I/O adapter card 233.

A storage device, such as hard disk drive 236 is coupled to a PCI bus, such as bus 228, via an I/O adapter card 238. Hard disk drive 236 may be implemented using any type of technology.

Another storage drive 240, such as a storage drive that receives removable media, is included in system 200. Storage drive 240 is coupled to PCI bus 226 via an I/O adapter card 242. Digital media drive 240 may be utilized to read, i.e. play, data that is stored on digital storage removable media, such as a CD-ROM, DVD-ROM, floppy disk, or other removable media, when that digital storage media is inserted into digital media drive 240. Other types of digital storage media may be utilized in digital media drive 240 to play the data that is stored in the digital storage media.

Computer system 200 includes an RFID transmitter/receiver reader device 250. RFID reader 250 includes a serial interface 252 for coupling RFID reader 250 to I/O bus 212 so that RFID reader 250 can communicate with I/O bus 212. RFID reader 250 also includes a radio frequency (RF) interface 254 to which an antenna 256 is coupled. RF interface 254 receives and transmits radio frequency signals utilizing antenna 256.

RFID reader 250 is capable of transmitting RFID interrogation signals and receiving and processing reply signals from RFID tags.

Computer system 200 also includes a global positioning system (GPS) device 260. GPS device 260 includes a serial interface 262 for coupling GPS device 260 to I/O bus 212 so that GPS device 260 can communicate with I/O bus 212. GPS device 260 also includes a radio frequency (RF) interface 264 to which an antenna 266 is coupled. RF interface 264 receives and transmits radio frequency signals utilizing antenna 266.

Those of ordinary skill in the art will appreciate that the hardware depicted in FIG. 2 may vary. For example, other peripheral devices, such as optical disk drives and the like, also may be used in addition to or in place of the hardware depicted. The depicted example is not meant to imply architectural limitations with respect to the preferred embodiment.

Figure 3:
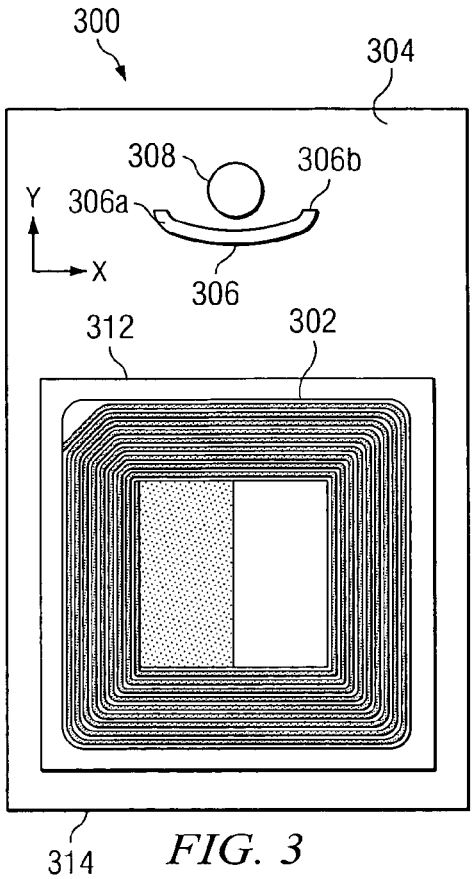
FIG. 3 is a block diagram of a tilt detecting device in an inactivated state in accordance with an illustrative embodiment of the present invention.

FIG. 3 is a block diagram of a tilt detecting device 300 in an inactivated state in accordance with an illustrative embodiment of the present invention. Tilt detecting device 300 includes an RFID tag 302 that is enclosed within a shielded casing 304. RFID tag 302 is preferably a passive RFID tag although active RFID tags may be utilized. When RFID tag 302 is completely enclosed within casing 304, as depicted by FIG. 3, RFID tag 302 will not respond to RFID interrogation signals that are transmitted by an RFID reader.

Tilt detecting device 300 is preferably affixed to a product that needs to be monitored. Tilt detecting device 300 includes a curved ledge 306 on which a weight 308 rests. Ledge 306 preferably includes a curved lip 306*a* formed at a first end of ledge 306 and a curved lip 306*b* formed at a second end of ledge 306. The amount of the curve of lip 306*a* may be different from the amount of curve of lip 306*b*.

Weight 308 is preferably implemented using one or more ball bearings. The number, weight, and size of ball bearings used to implement weight 308 are dependent on the amount of force that is necessary in order to push RFID tag 302 out of casing 304.

When tilt detecting device 300 is rotated past a predetermined threshold, either to the left or right, weight 308 will roll off of ledge 306. A first predetermined threshold is implemented using the amount of curvature that is formed in lip 306*a*. A second predetermined threshold is implemented using the amount of curvature that is formed in lip 306*b*. A slightly curved lip will detect slighter tilting while a more significantly curved lip will detect only greater tilting and will not detect the slighter tilting. The predefined threshold is the amount of tilting that is required in order to cause weight 308 to roll off of ledge 306.

Tilt detecting device 300 is initially oriented on the product in a vertical manner with zero degrees of tilt from the Y-axis. When tilting occurs with respect to the Y-axis, if the tilting is more than the predetermined threshold, weight 308 will roll off of ledge 306 and onto RFID tag 302 thereby pushing RFID tag 302 out of casing 304.

Figure 4:
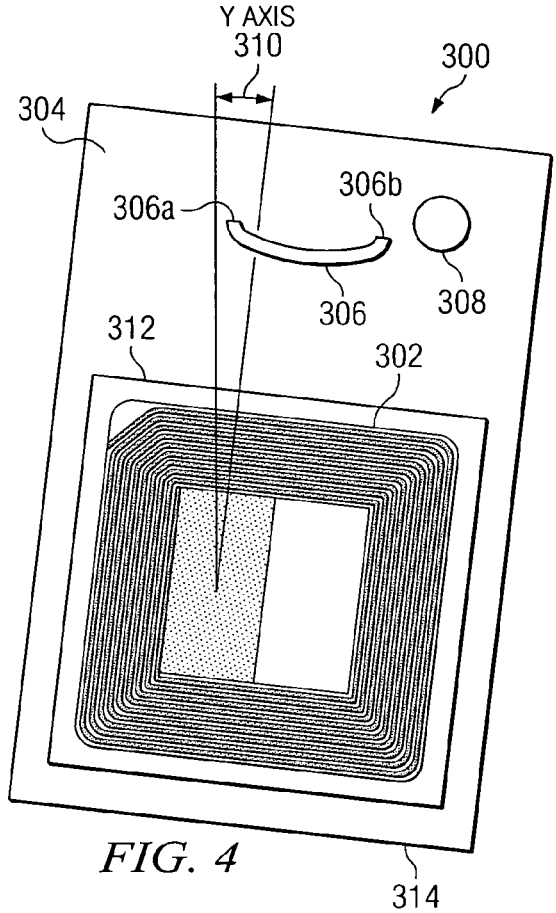
FIG. 4 depicts a tilt detecting device being tilted at an angle that exceeds the predefined threshold in accordance with an illustrative embodiment of the present invention.
Figure 5:
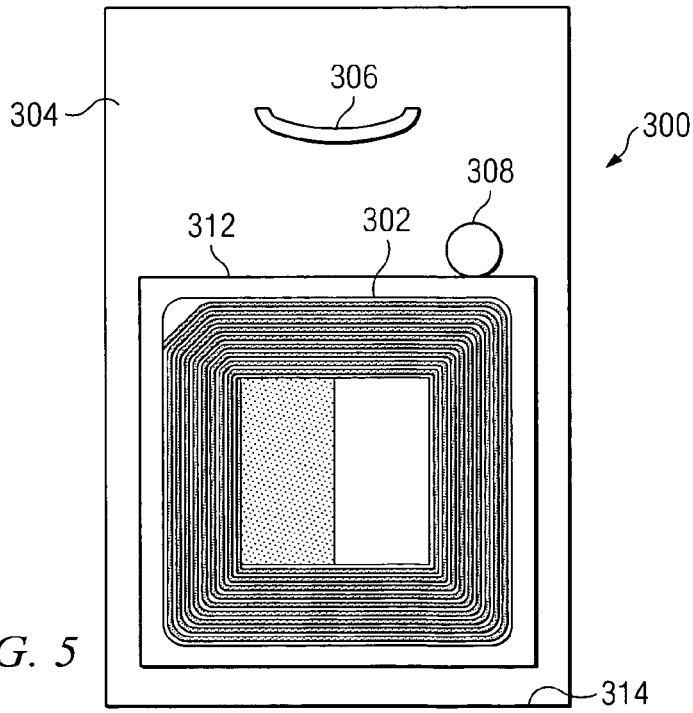
FIG. 5 illustrates the weight included within the tilt detecting device rolling off a ledge because the predefined threshold has been exceeded in accordance with the illustrative embodiment of the present invention.

FIG. 4 depicts the tilt detecting device 304 being tilted at an angle 310 from vertical which exceeds the predefined threshold implemented as the particular amount of curvature of lip 306*b* in accordance with an illustrative embodiment of the present invention. FIG. 5 illustrates weight 308 of the tilt detecting device rolling off of ledge 306 because the predefined threshold has been exceeded in accordance with the illustrative embodiment of the present invention. Because tilt detecting device 300 has been tilted beyond the predetermined threshold, weight 308 rolls off of ledge 306 and onto a top 312 of RFID tag 302. Tilt detecting device 300 is oriented such that RFID tag 302 is below ledge 306 when affixed to a product.

Figure 6:
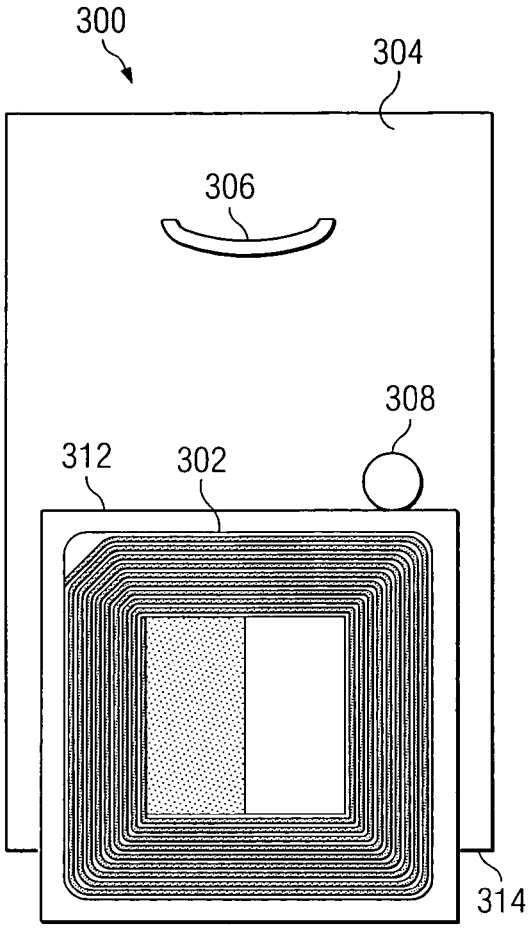
FIG. 6 depicts the weight that is included within the tilt detecting device pushing an RFID tag out of the RFID tag's casing in accordance with an illustrative embodiment of the present invention.

FIG. 6 depicts the weight that is included within the tilt detecting device pushing RFID tag 302 out of casing 304 in accordance with an illustrative embodiment of the present invention. The effect of gravity in combination with the weight of weight 308 provides enough force to push RFID tag 302 through a partially open bottom 314 of casing 304 and out of casing 304.

Figure 7:
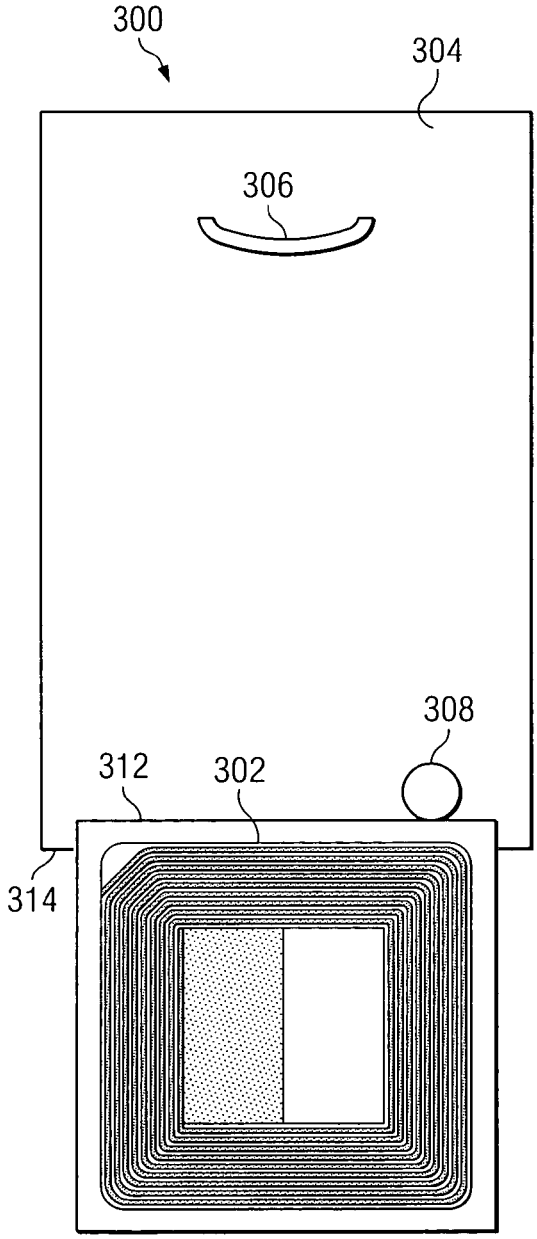
FIG. 7 illustrates the RFID tag being exposed to radio frequency (RF) signals and being capable of receiving and responding to RF signals in accordance with an illustrative embodiment of the present invention.

FIG. 7 illustrates the RFID tag now being exposed to RFID interrogation signals and being capable of receiving these RFID interrogation signals and responding with RFID reply signals in accordance with an illustrative embodiment of the present invention. When RFID tag 302 is pushed out of casing 304, RFID tag 302 is exposed and no longer shielded from RFID interrogation signals. Once exposed, RFID tag 302 will respond to an RFID interrogation signal that it receives from an RFID reader. RFID tag 302 will respond by transmitting its unique RFID identifier. In this manner, reader 250 can identify this particular tilt detecting device as having been tilted beyond its threshold.

Figure 8:
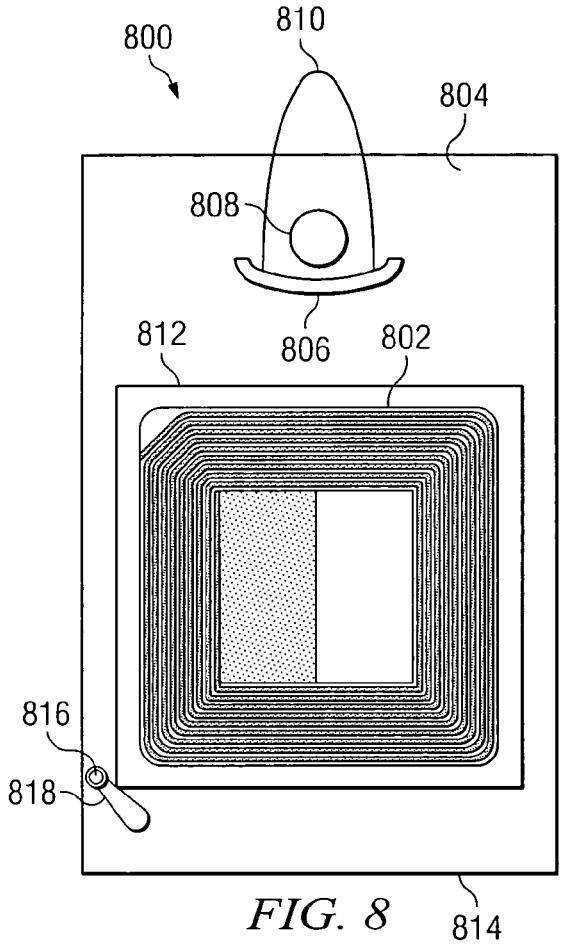
FIG. 8 is a block diagram of a tilt detecting device in an inactivated state in accordance with an illustrative embodiment of the present invention.

FIG. 8 is a block diagram of a tilt detecting device 800 in an inactivated state in accordance with an illustrative embodiment of the present invention. Tilt detecting device 800 includes an RFID tag 802 that is enclosed within a shielded casing 804. RFID tag 802 is preferably a passive RFID tag although active RFID tags may be utilized. When RFID tag 802 is completely enclosed within casing 804, as depicted by FIG. 8, RFID tag 802 will not respond to RFID interrogation signals that are transmitted by an RFID reader.

Tilt detecting device 800 is preferably affixed to a product that needs to be monitored. Tilt detecting device 800 includes a curved ledge 806 on which a weight 808 rests. Tilt detecting device 800 includes a removable member 810 that prevents weight 808 from rolling off of ledge 806. Tilt detecting device 800 is shown in an inactivated state with removable member 810 temporarily inserted in tilt detecting device 800. When removable member 810 is inserted in tilt detecting device 800, removable member 810 prevents weight 808 from rolling off of ledge 806 and onto top 812 of RFID tag 802 which would push RFID tag 802 out of casing 804. Removable member 810 can be removed from tilt detecting device 800 which enables weight 808 to move freely about and off of ledge 806 as tilt detecting device 800 is tilted.

Tilt detecting device 800 also includes a retaining member 816 that retains RFID tag 802 within casing 804 prior to weight 808 rolling off of ledge 806 and keeps RFID tag 802 from falling out of partially open bottom 814 of casing 804. When weight 808 rolls off of ledge, weight 808 is heavy enough to force retaining member 816 to move and thus release RFID tag 802, permitting RFID tag 802 to move out of casing 804. When tilt detecting device 800 is in an inactivated state, retaining member 816 is in a retaining position 818.

Figure 9:
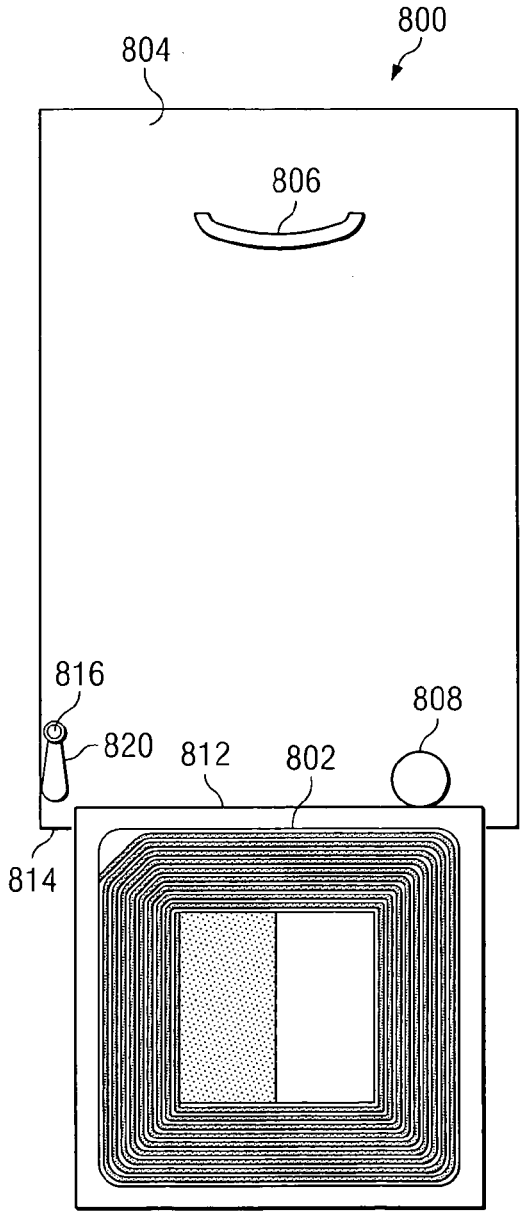
FIG. 9 illustrates an RFID tag that is exposed to RFID interrogation signals and that is capable of receiving these RFID interrogation signals and responding with RFID reply signals in accordance with an illustrative embodiment of the present invention.

FIG. 9 illustrates RFID tag 802 now being exposed to RFID interrogation signals and being capable of receiving these RFID interrogation signals and responding with RFID reply signals in accordance with an illustrative embodiment of the present invention. After removable member 810 is removed and enough tilting has occurred to cause weight 808 to roll off of ledge 806, weight 808 pushes RFID tag 802 out of casing 804. At this time, retaining member 816 is in an opened position 820 (see FIG. 8).

Figure 10:
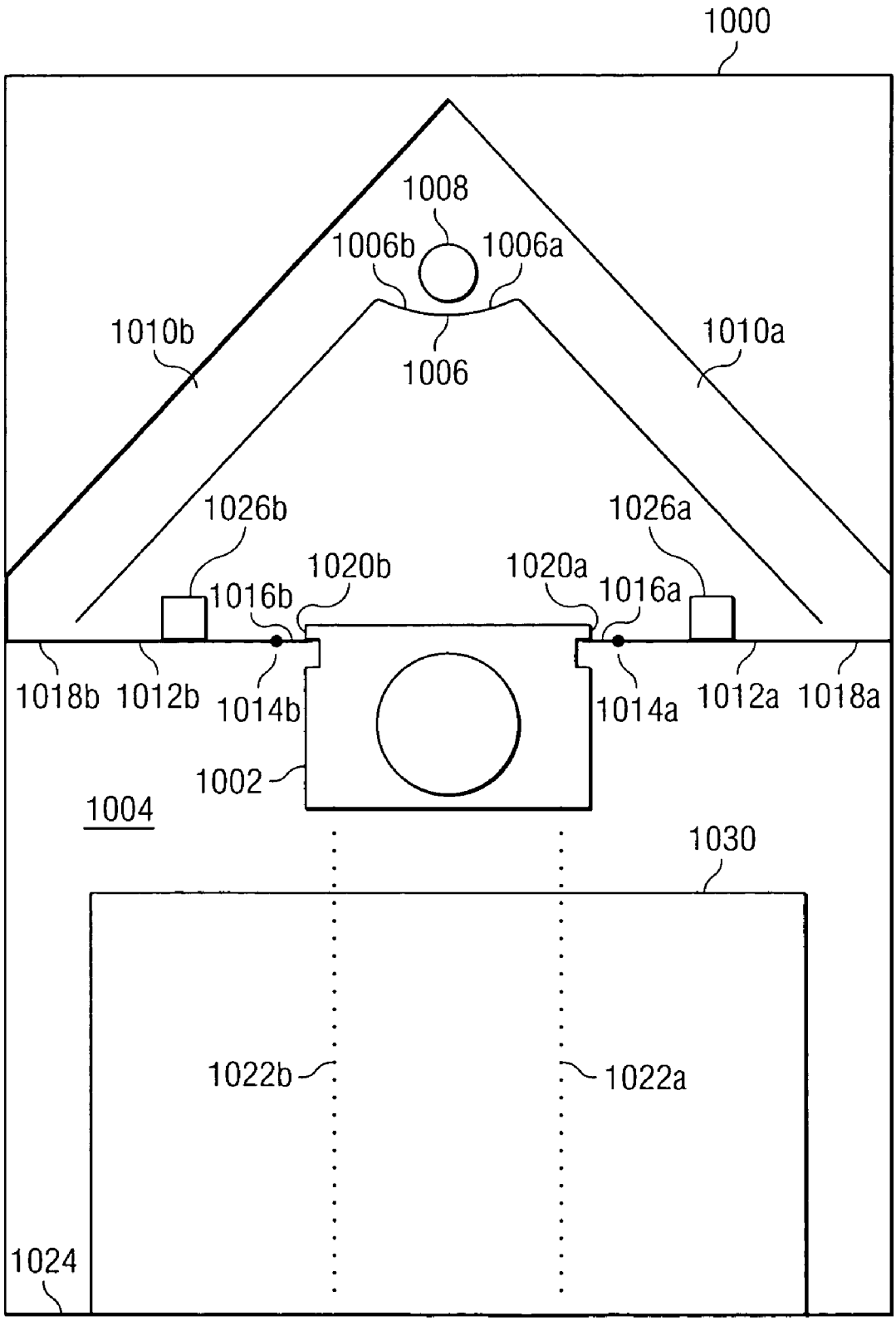
FIG. 10 illustrates a second embodiment tilt detecting device in an inactivated state in accordance with the illustrative embodiment of the present invention.

FIG. 10 illustrates a second embodiment tilt detecting device 1000 in an inactivated state in accordance with the illustrative embodiment of the present invention. Tilt detecting device 1000 includes an RFID tag 1002 that is enclosed within a shielded casing 1004. RFID tag 1002 is preferably a passive RFID tag although active RFID tags may be utilized. When RFID tag 1002 is completely enclosed within casing 1004, as depicted by FIG. 10, RFID tag 1002 will not respond to RFID interrogation signals that are transmitted by an RFID reader.

Tilt detecting device 1000 is preferably affixed to a product that needs to be monitored. Tilt detecting device 1000 includes a curved ledge 1006 on which a weight 1008 rests. Ledge 1006 preferably includes a curved lip 1006*a* formed at a first end of ledge 1006 and a curved lip 1006*b* formed at a second end of ledge 1006. The amount of the curve of lip 1006*a* may be different from the amount of curve of lip 1006*b*.

Tilt detecting device 1000 includes a channel 1010*a* and a channel 1010*b* through which weight 1008 is permitted to travel.

A lever 1012*a* is attached to a hinge 1014*a*. Lever 1012*a* includes a first end 1016*a* and a second end 1018*a*. When tilt detecting device 1000 is in an inactivated state, first end 1016*a* supports a notched first end 1020*a* of RFID tag 1002.

A lever 1012*b* is attached to a hinge 1014*b*. Lever 1012*b* includes a first end 1016*b* and a second end 1018*b*. When tilt detecting device 1000 is in an inactivated state, first end 1016*b* supports a notched second end 1020*b* of RFID tag 1002.

Tilt detecting device 1000 includes one or more springs, such as springs 1022*a* and 1022*b*. Springs 1022*a* and 1022*b* are attached to RFID tag 1002 and provide a downward tension on RFID tag 1002 urging RFID tag 1002 toward a bottom 1024 of tilt detecting device 1000. RFID tag 1002 is prevented from moving toward bottom 1024 when tilt detecting device 1000 is in an inactivated state by levers 1012*a* and 1012*b*.

When tilt detecting device 1000 is in an inactivated state, second end 1018*a* of first lever 1012*a* is prevented from pivoting toward channel 1010*a* by channel 1010*a* and by a stationary stop 1026*a*.

When tilt detecting device 1000 is in an inactivated state, second end 1018*b* of second lever 1012*b* is prevented from pivoting toward channel 1010*b* by channel 1010*b* and by a stationary stop 1026*b*.

Figure 11:
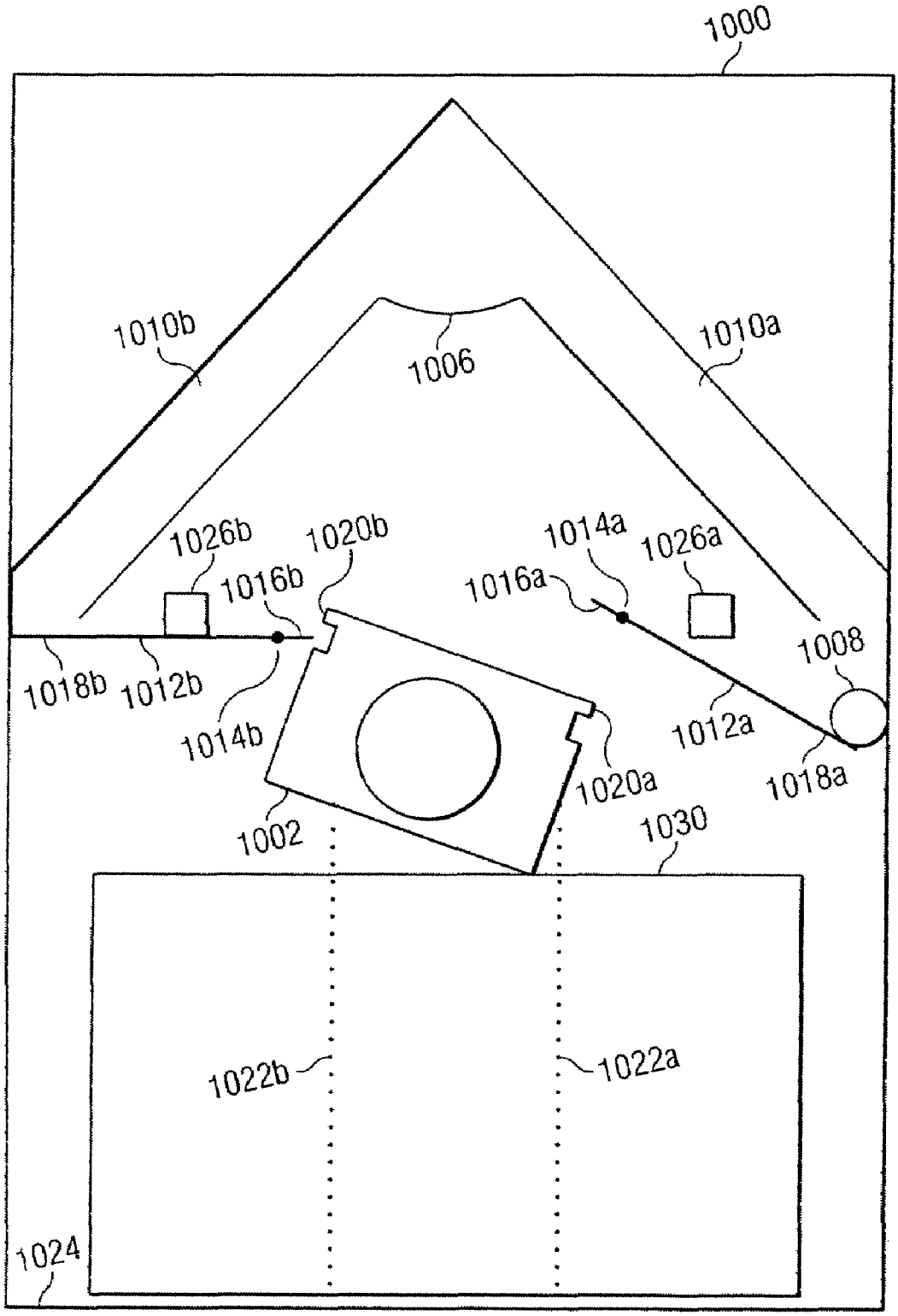
FIG. 11 illustrates a second embodiment tilt detecting device being tilted at an angle that exceeds the predefined threshold in accordance with an illustrative embodiment of the present invention.

FIG. 11 illustrates a second embodiment tilt detecting device being tilted at an angle that exceeds the predefined threshold in accordance with an illustrative embodiment of the present invention. When tilt detecting device 1000 is tilted beyond its predetermined threshold to the right, weight 1008 will roll off of lip 1006*a* of ledge 1006 and into channel 1010*a*. Weight 1008 will then travel through channel 1010*a* to lever 1012*a*. When weight 1008 falls on second end 1018*a* of lever 1012*a*, weight 1008 is heavy enough to cause lever 1012*a* to pivot about hinge 1014*a* and to cause first end 1016*a* to disengage from first end 1020*a*. RFID tag 1002 is then pulled toward bottom 1024 by spring 1022*a*.

When tilt detecting device 1000 is tilted beyond its predetermined threshold to the left, weight 1008 will roll off of lip 1006*b* of ledge 1006 and into channel 1101*b*. Weight 1008 will then travel through channel 1010*b* to lever 1012*b*. When weight 1008 falls on second end 1018*b* of lever 1012*b*, weight 1008 is heavy enough to cause lever 1012*b* to pivot about hinge 1014*b* and to cause first end 1016*b* to disengage from second end 1020*b*. RFID tag 1002 is then pulled toward bottom 1024 by spring 1022*b*.

The tension exerted on first end 1020*a* by spring 1022*a* causes second end 1020*b* to be disengaged from first end 1016*b* of lever 1012*b*. RFID tag 1002 then moves into an unshielded portion 1030 of tilt detecting device 1000. When RFID tag 1002 is in unshielded portion 1030, RFID tag 1002 is capable of receiving and transmitting radio frequency (RF) signals.

Weight 1008 is preferably implemented using one or more ball bearings. The number, weight, and size of ball bearings used to implement weight 1008 are dependent on the amount of force that is necessary in order to push first end 1016*a* of lever 1012*a* open enough to disengage first end 1016*a* from first end 1020*a* of RFID tag 1002, and the amount of force that is necessary in order to push first end 1016*ba* of lever 1012*b* open enough to disengage first end 1016*b* from second end 1020*b* of RFID tag 1002.

Figure 12:
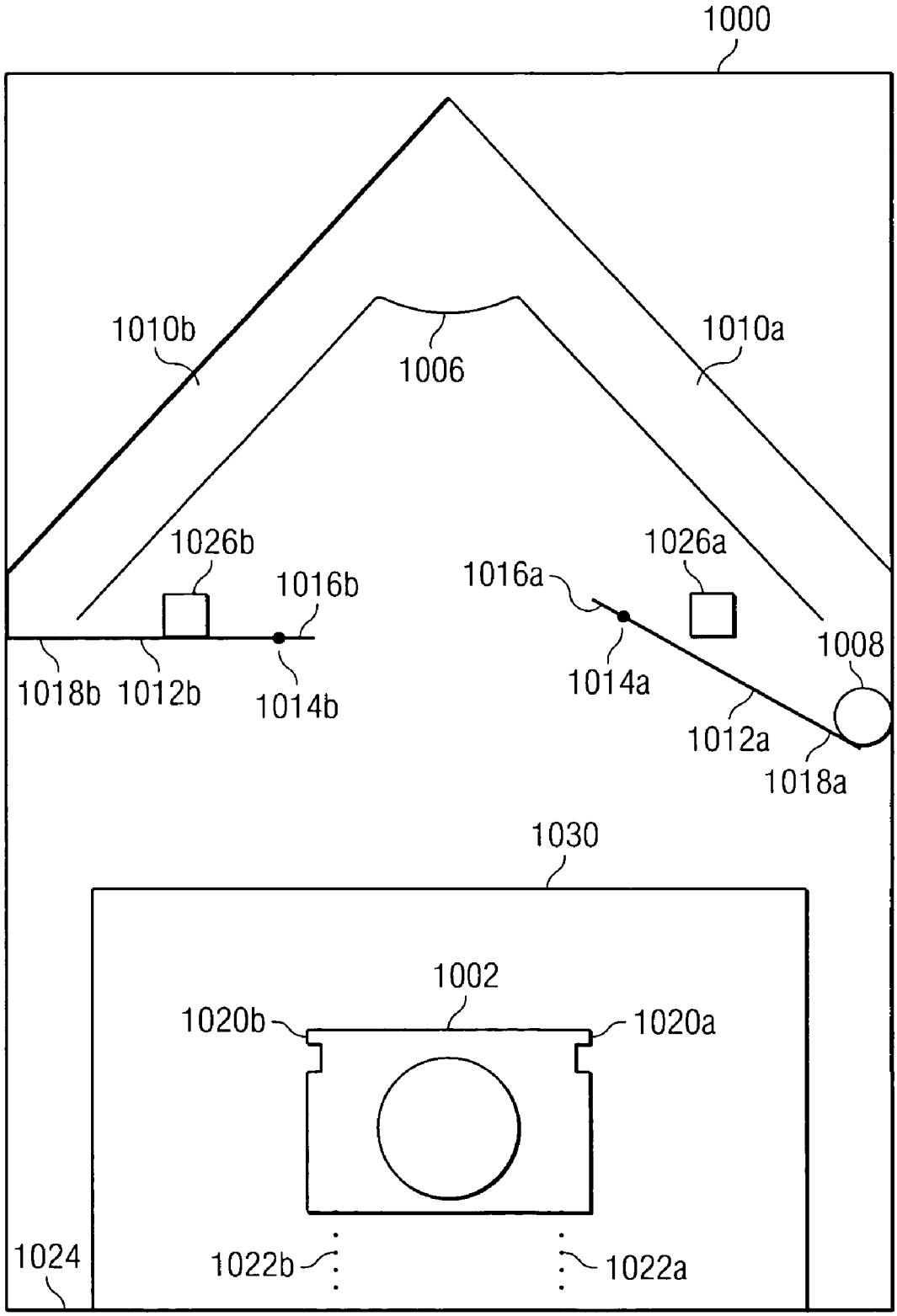
FIG. 12 illustrates a second embodiment tilt detecting device after its RFID tag has been exposed in accordance with the illustrative embodiment of the present invention.

FIG. 12 illustrates a second embodiment tilt detecting device after its RFID tag has been exposed in accordance with the illustrative embodiment of the present invention. RFID tag 1002 has moved into unshielded portion 1030 and is now capable of receiving and responding to RF signals.

Figure 13:
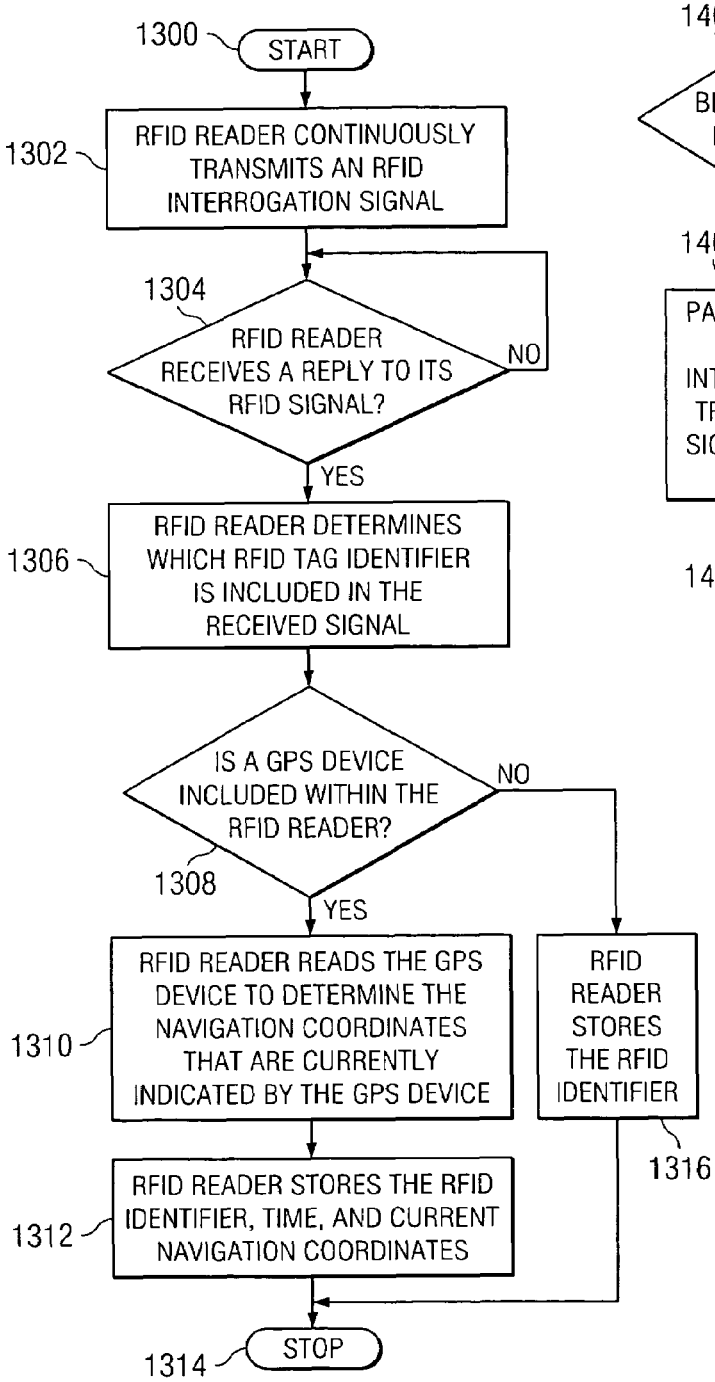
FIG. 13 depicts a high level flow chart that depicts an RFID reader reading exposed RFID tags in accordance with an illustrative embodiment of the present invention.

FIG. 13 is a high level flow chart that depicts an RFID reader reading exposed RFID tags in accordance with an illustrative embodiment of the present invention. The process starts as depicted by block 1300 and thereafter passes to block 1302 which illustrates an RFID reader continuously transmitting an RFID interrogation signal. Thereafter, block 1304 depicts a determination of whether or not the RFID reader has received a reply to its RFID interrogation signal. If a determination is made that the RFID reader has not received a reply to its RFID interrogation signal, the process passes back to block 1304. Referring again to block 1304, if a determination is made that the RFID reader has received a reply to its RFID interrogation signal, the process passes to block 1306 which depicts the RFID reader determining which RFID tag identifier is included in the received reply signal.

Thereafter, block 1308 illustrates a determination of whether or not there is a GPS device that is included within the RFID reader. If a determination is made that there is a GPS device that is included in the RFID reader, the process passes to block 1310. Block 1310 depicts the RFID reader reading the GPS device to determine the navigation coordinates that are currently indicated by the GPS device. Next, block 1312 illustrates the RFID reader storing the RFID identifier, the current time, and the current navigation coordinates. The process then terminates as depicted by block 1314.

Referring again to block 1308, if a determination is made that no GPS device is included within the RFID reader, the process passes to block 1316 which depicts the RFID reader storing the RFID identifier. The process then terminates as depicted by block 1314.

Figure 14:
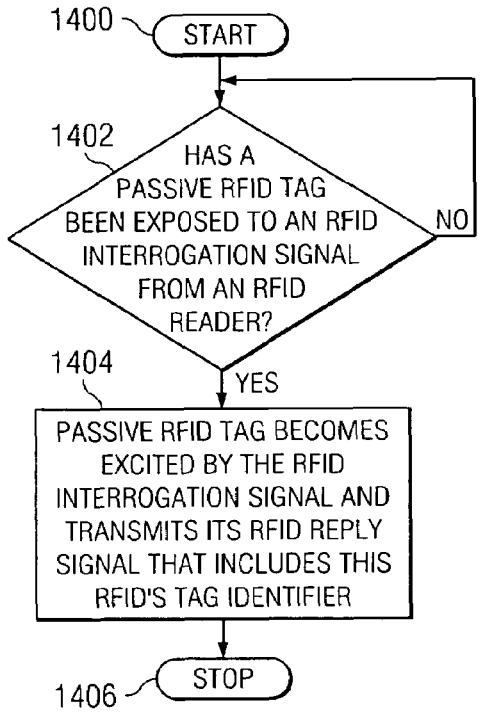
FIG. 14 illustrates a high level flow chart that depicts a radio frequency identification (RFID) tag responding to a radio frequency (RF) signal in accordance with an illustrative embodiment of the present invention.

FIG. 14 is a high level flow chart that illustrates a radio frequency identification (RFID) tag responding to a radio frequency (RF) signal in accordance with an illustrative embodiment of the present invention. The process starts as depicted by block 1400 and thereafter passes to block 1402 which illustrates a determination of whether or not the passive RFID tag has been exposed to an RFID interrogation signal that was transmitted by an RFID reader. If a determination is made the RFID tag has not been exposed to an RFID interrogation signal from an RFID reader, the process passes back to block 1402.

Referring again to block 1402, if a determination is made the RFID tag has been exposed to an RFID interrogation signal transmitted by an RFID reader, the process passes to block 1404 which depicts the passive RFID tag becoming excited by the RFID interrogation signal that was received from the RFID reader. The RFID reader then transmits a reply RFID signal. This reply RFID signal includes the RFID tag identifier which identifies this particular RFID tag. The process then terminates as illustrated by block 1406.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the preferred embodiment has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for detecting whether a device has been tilted beyond a predefined threshold, said apparatus comprising:

a casing for temporarily enclosing a radio frequency identification (RFID) tag, said RFID tag being unable to receive an RFID interrogation signal when said RFID tag is enclosed in said casing;

said apparatus detecting an amount of tilt of said device; and in response to said amount of tilt exceeding said predefined threshold, said RFID tag being exposed to RFID interrogation signal and said RFID tag receiving said RFID interrogation signal when said RFID tag is exposed; and said RFID tag transmitting a reply RFID signal in response to a receipt by said RFID tag of said RFID interrogation signal, said RFID tag transmitting said reply RFID signal only when said RFID tag is exposed, said RFID reply signal indicating that said device has been tilted beyond said predefined threshold.

2. The apparatus according to claim 1, further comprising:

in response to said amount of tilt not exceeding said predefined threshold, said RFID tag remaining in said casing and not receiving said RFID interrogation signal.

3. The apparatus according to claim 1, further comprising:

a weighting device; and in response to said amount of tilt exceeding said predefined threshold, said weighting device causing said RFID tag to become exposed.

4. The apparatus according to claim 1, further comprising:

a ledge included within said casing for temporarily supporting a weighting device;

said weighting device resting on said ledge when said amount of tilt does not exceed said predefined threshold;

in response to said amount of tilt exceeding said predefined threshold, said weighting device being moved from said ledge and onto said RFID tag causing said RFID tag to become exposed.

5. The apparatus according to claim 1, further comprising:
a ledge included within said casing for temporarily supporting a weighting device, said ledge including a lip curved into a first end of said ledge, an amount of said curve being said predefined threshold.

6. The apparatus according to claim 1, further comprising:
a ledge included within said casing for temporarily supporting a weighting device;
said weighting device resting on said ledge when said amount of tilt does not exceed said predefined threshold;
in response to said tilt exceeding said predefined threshold, said apparatus being activated by said weight rolling off of said ledge and onto a top of said RFID tag causing said RFID tag to be pushed out of said casing.

7. The apparatus according to claim 1, further comprising:
said device being affixed to a product that is completely enclosed within a package, said device being invisible to a person while said product is enclosed in said package.

8. The apparatus according to claim 1, further comprising:
at least one ball bearing that temporarily rests on a curved ledge; and
in response to said amount of tilt exceeding said predefined threshold, said at least one ball bearing rolling off of said ledge and onto a top of said RFID tag to cause said RFID tag to become exposed and capable of receiving said RFID interrogation signal.

9. The apparatus according to claim 1, further comprising:
a weighting device;
said RFID tag temporarily supported by a lever;
a spring urging said RFID tag into an unshielded portion of said apparatus;
in response to said amount of tilt exceeding said predefined threshold, said weighting device causing said lever to release said RFID tag, said spring causing said RFID tag to move into said unshielded portion when said lever is released; and
said RFID tag being exposed and said RFID tag receiving said RFID interrogation signal when said RFID tag is in said unshielded portion.

10. A method for detecting whether a device has been tilted beyond a predefined threshold, said method comprising:
temporarily enclosing a radio frequency identification (RFID) tag in a casing, said RFID tag being unable to receive an RFID interrogation signal when said RFID tag is enclosed in said casing;
detecting an amount of tilt of said device;
in response to said amount of tilt exceeding said predefined threshold, exposing said RFID tag to interrogation signal;
receiving, by said exposed RFID tag, said RFID interrogation signal; and
transmitting, by said exposed RFID tag, a reply RFID signal in response to said receipt by said RFID tag of said RFID interrogation signal, said RFID tag transmitting said reply RFID signal only when said RFID tag is exposed, said RFID reply signal indicating that said device has been tilted beyond said predefined threshold.

11. The method according to claim 10, further comprising:
in response to said amount of tilt not exceeding said predefined threshold, preventing, by said casing, said RFID tag from receiving said RFID interrogation signal.

12. The method according to claim 10, further comprising:
providing a weighting device within said device; and
in response to said amount of tilt exceeding said predefined threshold, causing, by said weighting device, said RFID tag to become exposed.

13. The method according to claim 10, further comprising:
providing a ledge within said casing for temporarily supporting a weighting device;
said weighting device resting on said ledge when amount of tilt does not exceed said predefined threshold;
in response to said amount of tilt exceeding said predefined threshold, exposing said RFID tag utilizing said weighting device wherein said weighting device moving from said ledge and onto said RFID tag causing said RFID tag to become exposed.

14. The method according to claim 10, further comprising:
temporarily holding a weighting device on a ledge that is included within said casing, said ledge including a lip curved into a first end of said ledge, an amount of said curve being said predefined threshold.

15. The method according to claim 10, further comprising:
temporarily holding a weighting device on a ledge that is included within said casing;
said weighting device resting on said ledge when said amount of tilt does not exceed said predefined threshold;
in response to said amount of tilt exceeding said predefined threshold, pushing said RFID tag out of said casing by said weighting device, said weighting device rolling off of said ledge and onto a top of said RFID tag causing said RFID tag to be pushed out of said casing in response to said amount of tilt exceeding said predefined threshold.

16. The method according to claim 10, further comprising:
affixing said device to a product that is completed enclosed within a package, said device being invisible to a person while said product is completely enclosed in said package.

17. The method according to claim 10, further comprising:
at least one ball bearing that temporarily rests on a curved ledge in said casing; and
in response to said amount of tilt exceeding said predefined threshold, exposing said RFID tag utilizing at least one ball bearing that rolls off of a ledge that is included in said casing and onto a top of said RFID tag to cause said RFID tag to become exposed and capable of receiving said RFID interrogation signal.

18. The method according to claim 10, further comprising:
reading said reply RFID signal by an RFID reader, said reply RFID signal including an identifier that uniquely identifies said RFID tag.

19. The method according to claim 10, further comprising:
reading said reply RFID signal by an RFID reader, said reply RFID signal including an identifier that uniquely identifies said RFID tag;
reading navigational coordinates of said RFID reader in response to a receipt of said reply RFID signal; and
storing said identifier and said navigational coordinates to indicate a tilt event that is an occurrence of said device being tilted beyond said predefined threshold.

20. The method according to claim 10, further comprising:
temporarily supporting said RFID tag by a lever;
urging said RFID tag into an unshielded portion of said apparatus utilizing a spring;
in response to said amount of tilt exceeding said predefined threshold, causing, by a weighting device said lever to release said RFID tag, said spring causing said RFID tag to move into said unshielded portion when said lever is released; and
exposing said RFID tag, said RFID tag receiving said RFID interrogation signal when said RFID tag is in said unshielded portion.

* * * * *